US005836047A

United States Patent [19]

Lee et al.

[11] Patent Number: 5,836,047

[45] Date of Patent: Nov. 17, 1998

[54] VACUUM CLEANER FOR BOTH UPRIGHT AND CANISTER MODES

[75] Inventors: Jin Bang Lee; Byung Cheol Choi, both of Incheon; Seon Kyu Kim; Yeong Je Jeon, both of Seoul; Seon Young Hong, Kyeongki-Do; Nam Ho Lee, Seoul, all of Rep. of Korea

[73] Assignee: Daewoo Electronics Co., Inc., Seoul, Rep. of Korea

[21] Appl. No.: 795,186

[22] Filed: Feb. 4, 1997

Related U.S. Application Data

[63] Continuation-in-part of Ser. No. 310,983, Sep. 23, 1994, abandoned.

[30] Foreign Application Priority Data

Jan. 20, 1994 [KR] Rep. of Korea ..... 94-1043
Feb. 24, 1994 [KR] Rep. of Korea ..... 94-3391

[51] Int. Cl.[6] ..... A47L 5/36

[52] U.S. Cl. ..... 15/328; 15/335; 15/351; 15/377

[58] Field of Search ..... 15/328, 335, 351

[56] References Cited

U.S. PATENT DOCUMENTS

| | | | |
|---|---|---|---|
| 3,039,130 | 6/1962 | Belicka et al. | 15/377 |
| 3,220,043 | 11/1965 | Lampe | 15/351 X |
| 4,190,307 | 2/1980 | Eckart | 15/351 X |
| 4,571,772 | 2/1986 | Dyson | 15/335 |
| 4,761,850 | 8/1988 | Romeo et al. | 15/335 X |
| 4,905,341 | 3/1990 | Sunagawa et al. | 15/351 X |
| 4,959,885 | 10/1990 | Sovis et al. | 15/335 |
| 5,054,157 | 10/1991 | Werner et al. | 15/328 |
| 5,168,598 | 12/1992 | Hashizume et al. | 15/351 X |

FOREIGN PATENT DOCUMENTS

| | | | |
|---|---|---|---|
| 494786 | 11/1938 | United Kingdom | 15/335 |

*Primary Examiner*—Chris K. Moore
*Attorney, Agent, or Firm*—Sixbey, Friedman, Leedom & Ferguson; Frank P. Presta; Joseph S. Presta

[57] ABSTRACT

A vacuum cleaner has a cleaner body section having a first recess, and a second recess. The vacuum cleaner further has a first connector section, a second connector section, a suction pipe section and a brush section. First and second arc-shaped slots are provided in order for first and second protrusions of the first connector section to be slidably inserted in the slots and to be placed on the first recess. The second connector section is fixedly inserted in the second recess. The first connector section is connected to the second connector section. When the vacuum cleaner is used in the upright mode, the brush section is detachably connected to the first connector section and the suction pipe section is detachably connected to the second connector section, to thereby provide an air passageway from the brush section, the first connector section, the second connector section, and the suction pipe section, up to the cleaner body section. When the vacuum cleaner is used in the canister mode, the brush section is detachably connected to the suction pipe section directly to provide an air passageway from the brush section to the cleaner body section.

10 Claims, 9 Drawing Sheets

VACUUM CLEANER FOR BOTH UPRIGHT AND CANISTER MODES

This is a continuation-in-part of application Ser. No. 08/310,983, filed Sep. 23, 1994, which is now abandoned.

BACKGROUND OF THE INVENTION

1. Field of the Invention

The present invention relates to a vacuum cleaner, and more particularly to a vacuum cleaner for both upright and canister modes.

2. Prior Art

Generally, a vacuum cleaner may be classified into a canister mode vacuum cleaner and an upright mode vacuum cleaner. In a conventional canister mode vacuum cleaner, a cleaner body has a dirt collecting chamber and an air suction chamber. The cleaner body and a brush section are separated from each other, and they are connected with each other through suction pipes and a flexible hose. Further, a grip is formed on one of the suction pipes connected to the brush section, and thereby the cleaner body and the brush section are moved together when the cleaner is used. Also, the cleaner body is provided with wheels so that it can be moved easily.

During the cleaning operation using the canister mode vacuum cleaner, a user can easily move a brush section to an area to be cleaned without holding up a cleaner body having a large volume and heavy weight, and the cleaner body can be independently moved from the brush section. Therefore, the canister mode vacuum cleaner has advantages in that handling of the cleaner during a cleaning operation is easy, and every nook and corner can be cleaned.

However, the cleaner occupies large space when stored because its entire volume is large. Moreover, maintenance of airtightness, and assembling for storage use or disassembling for cleaning use are difficult because the cleaner has many members to be connected with each other such as suction pipes, a flexible hose, etc., and because a suction air pipe is long. Furthermore, the handling of the cleaner during a cleaning operation may cause annoyance to a user because the cleaner body and the brush section are moved independently from each other.

In contrast, when using the upright mode vacuum cleaner, a brush section is connected directly to a lower part of the cleaner body without using suction pipes and a flexible hose, etc., and a grip is disposed directly at an upper part of the cleaner body. Therefore, the upright mode vacuum cleaner has advantages in that the handling of the cleaner during a cleaning operation is simple, the volume thereof is small, and the storage thereof is convenient. However, since the cleaner body and the brush section are moved altogether, the weight of handling by a user during a cleaning operation is too heavy, and it is also difficult to clean every nook and corner.

Various efforts have been made to develop a vacuum cleaner which complements the advantages and overcomes the disadvantages of the general vacuum cleaners in the above two modes. The result of one of the above efforts is U.S. Pat. No. 4,393,536 issued to Tapp. Tapp discloses a canister mode vacuum cleaner which may be ultilized in either a horizontal or substantially upright position of the canister.

FIG. 1 is a schematic constructional view of the conventional dual mode vacuum cleaner. As shown in FIG. 1, when the vacuum cleaner is used in an upright mode, a canister 20 is attached to one of a plurality of suction pipes 30 which is connected through attachment members 21 such as clamps disposed at even spaces along the suction pipe 30. Air suctioned through a brush section 40 is exhausted through the brush section 40 after having been filtered through the canister 20.

The conventional dual mode vacuum cleaner, as shown in FIG. 1, aims to provide a dual mode vacuum cleaner wherein suction efficiency increases without increasing the driving force of the motor. However, the conventional dual mode vacuum cleaner does not disclose both the construction and shape of the attachment members 21 for assembling the canister 20 with the suction pipes 30, and because the filtered air is exhausted through the brush section 40, the dirty matter near an area to be cleaned is scattered by the exhausted air, thereby reducing cleaning efficiency.

SUMMARY OF THE INVENTION

It is an object of the present invention to provide a vacuum cleaner for both upright and canister modes. In order to attain the object, the present invention comprises a cleaner body section having a first recess in which a first connector section is placed, which is formed at a first or bottom side of the cleaner body section, and a second recess in which a second connector section is placed, which is formed at second or rear side of the cleaner body section, wherein the first and second sides form a right angle, and a couple of fitting portions are provided at the first side adjacent to the second side, the first and second fitting portions are spaced at a predetermined distance from each other and each has first and second slots shaped like an arc, respectively. The vacuum cleaner for both upright and canister modes further comprises a brush section being in contact with a place to be cleaned and providing an air passageway therein for the dirt-bearing air and the first connector section having first and second protrusions which protrude in the opposite directions to insert into the first and second slots, respectively, and the first connector section detachably connected to the brush section, and for providing an air passageway for the dirt-bearing air to enter from the brush section, wherein the first and second protrusions are slidably connected in the first and second slots, respectively, while the first recess receives the first connector section to be slid along the first and second protrusions. The vacuum cleaner for both upright and canister modes comprises the second connector section fixedly inserted in the second recess and connected to the first connector section, and for providing an air passageway for the dirt-bearing air, and a suction pipe section detachably connecting the second connector section with the cleaner body section and for providing an air passageway for the dirt-bearing air to enter from the second connector section to the cleaner body section when in upright mode, whereas the suction pipe section detached from the second connector section is detachably connected to the brush section without the first connector section to provide an air passageway for the dirt-bearing air to enter directly from the brush section to the suction pipe section when in canister mode.

With the above structure, the vacuum cleaner of the present invention can be used in both a canister mode and an upright mode without reduction in cleaning performance and easily converted from the canister mode to the upright mode and vice versa.

BRIEF DESCRIPTION OF THE DRAWINGS

The above object, and other features and advantages of the present invention will become apparent by describing the preferred embodiment in detail with reference to the accompanying drawings, in which.

DETAILED DESCRIPTION OF THE PREFERRED EMBODIMENT

Hereinafter, the present invention will be described more detailedly with reference to the accompanying drawings.

Figure 1:
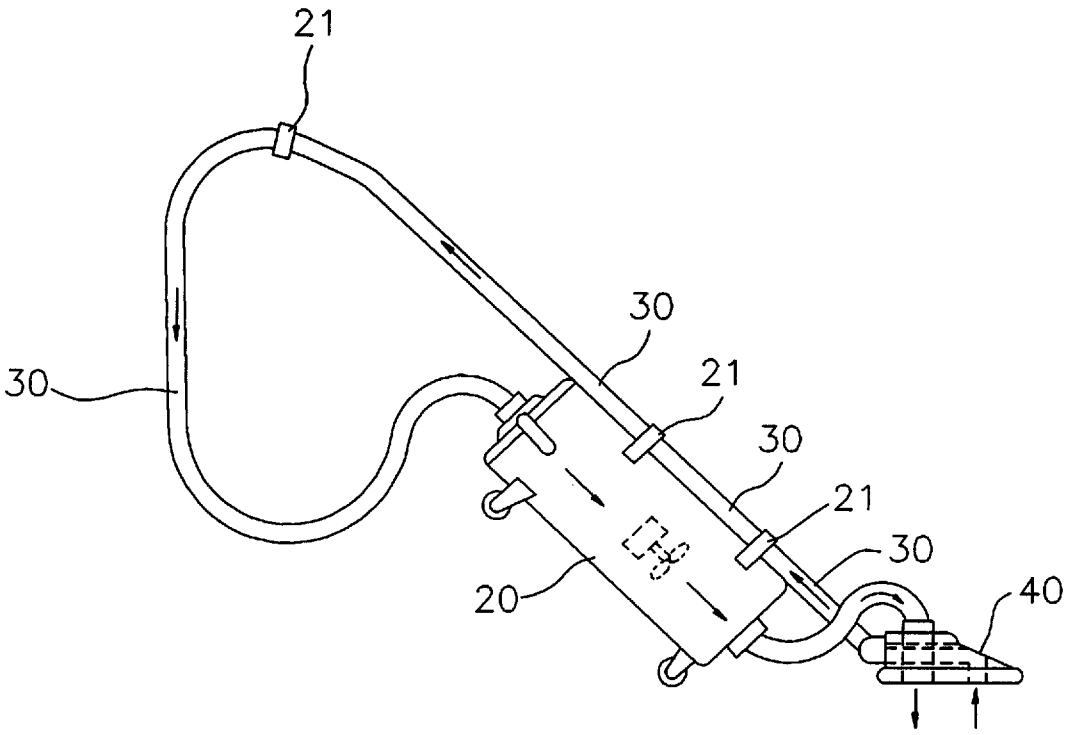
FIG. 1 PRIOR ART
FIG. 1 is a schematic constructional view of a conventional dual mode vacuum cleaner.
Figure 2:
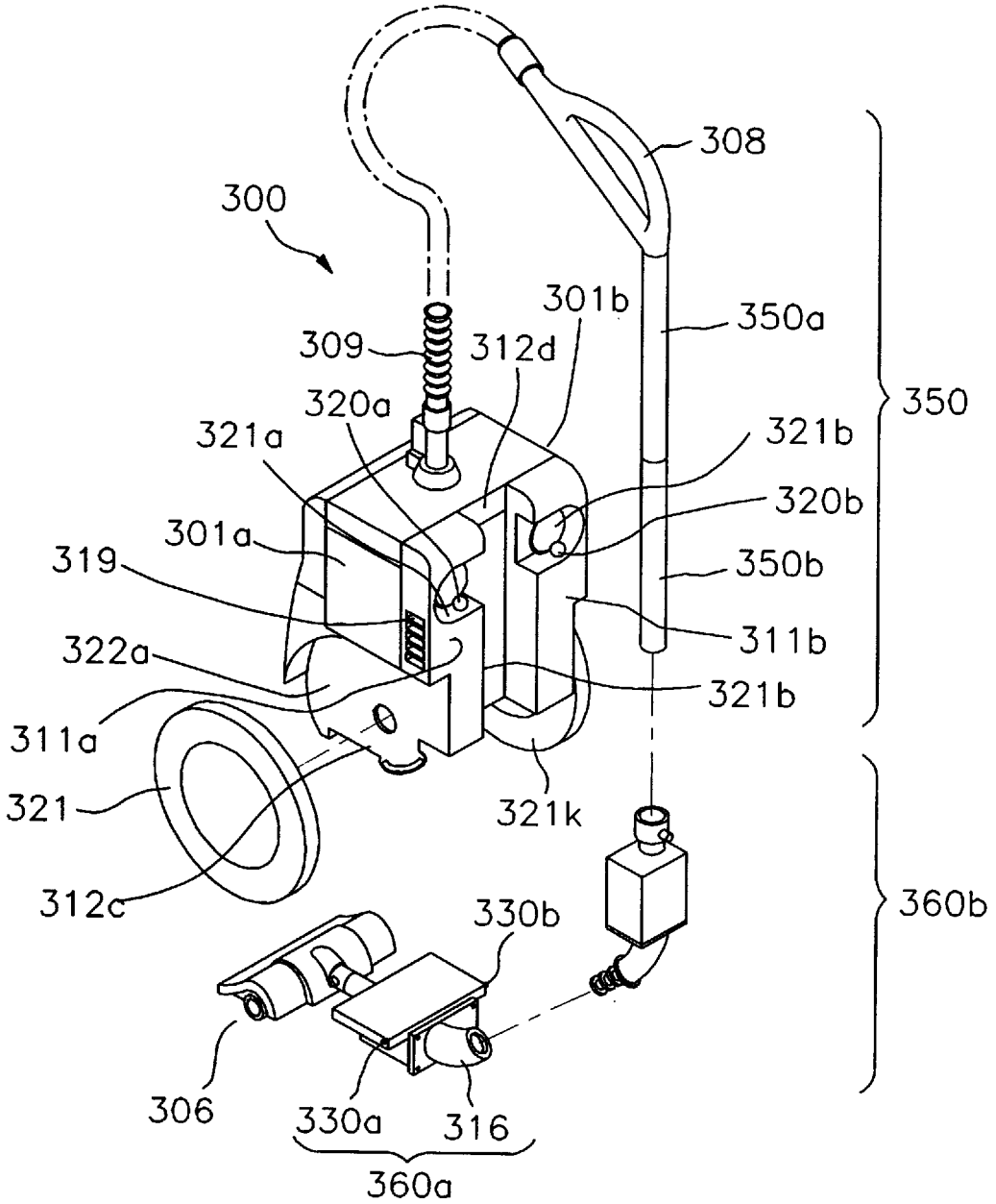
FIG. 2 is an exploded perspective view of a vacuum cleaner for both upright and canister modes according to an embodiment of the present invention.
Figure 2A:
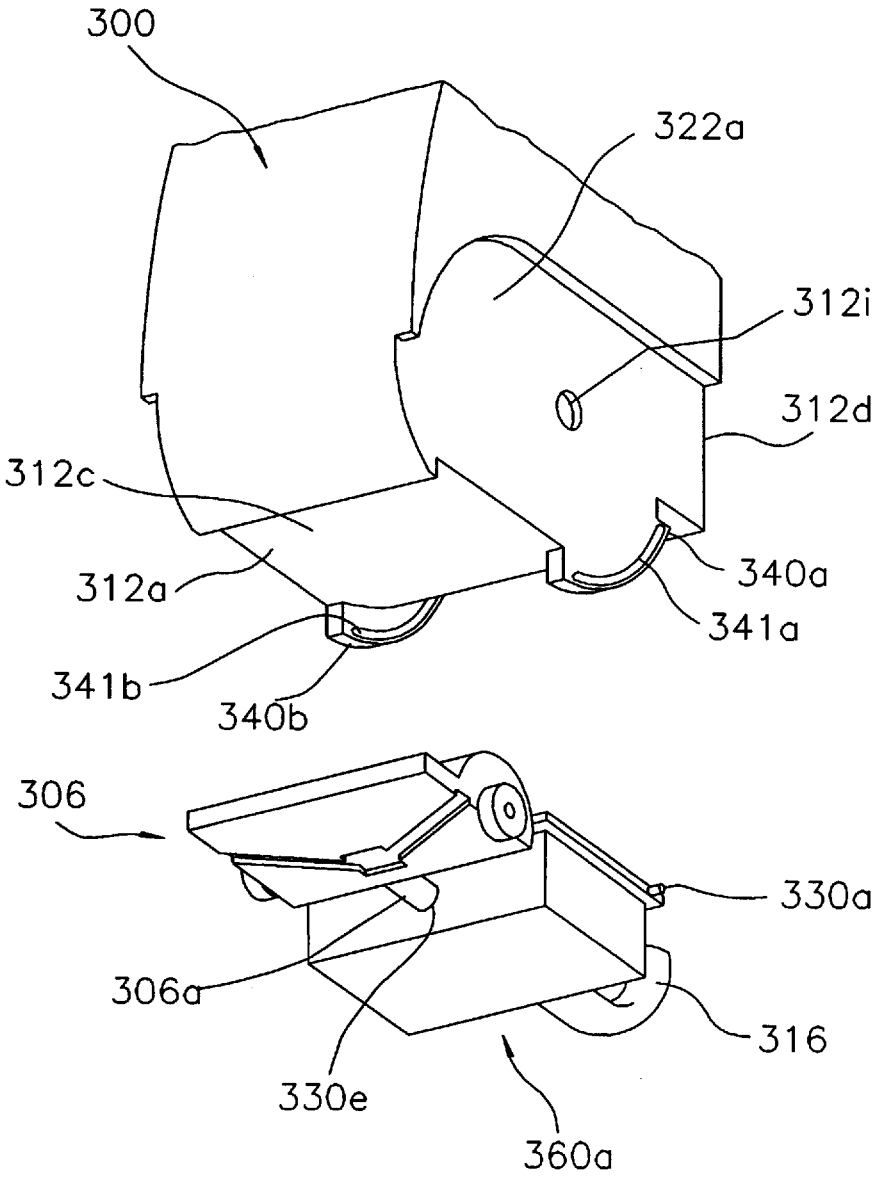
FIG. 2A is a first or bottom side view in connection with a first connector section when viewed in the direction of arrow A of FIG. 2.
Figure 3:
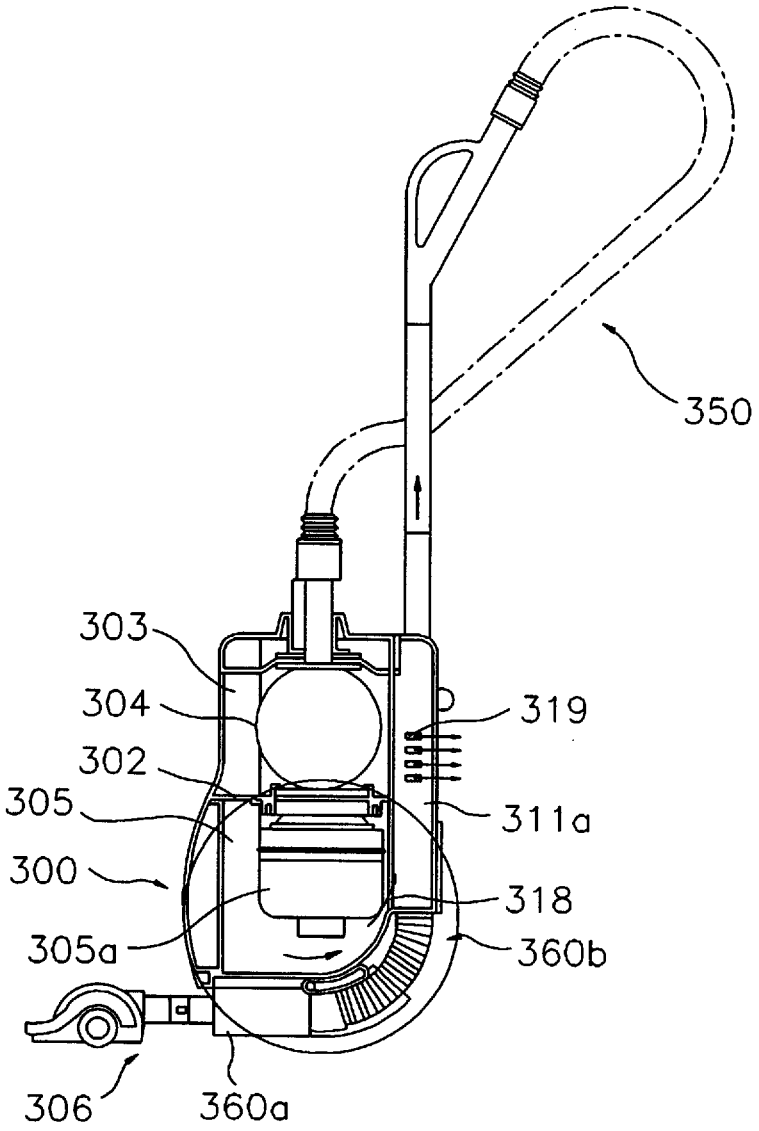
FIG. 3 is a partially cut-away schematic side elevation of the cleaner shown in FIG. 2 in an upright mode in which the cleaner body and the ground make a right angle.

FIG. 2 is an exploded perspective view of a vacuum cleaner for both upright and canister modes according to the embodiment of the present invention, FIG. 2A is a view of a first side of a cleaner body section in connection with a first connector section when viewed in the direction of arrow A of FIG. 2, and FIG. 3 is a partially cut-away schematic side elevation view of the cleaner shown in FIG. 2 in an upright mode in which the cleaner body and the ground form a right angle. As shown in FIG. 2, the vacuum cleaner according to an embodiment of the present invention comprises a cleaner body section 300, a suction pipe section 350, a first connector section 360*a*, a second connector section 360*b*, and a brush section 306.

As shown in FIGS. 2 and 2A, the cleaner body section 300 has a first recess 312*a* in which the first connector section 360*a* is placed, which is formed at a first or bottom side 312*c*, and a second recess 312*b* for housing the second connector section 360*b*, which is formed at a second or rear side 312*d*. The first or bottom side 312*c* and the second or rear side 312*d* form a right angle. A couple of fitting portions 340*a*, 340*b* are provided at the first side 312*c* adjacent to the second side 312*d*. The first and second fitting portions 340*a* and 340*b* are spaced at a predetermined distance from each other, and each has first and second slots 341*a* and 341*b* shaped like an arc, respectively. The cleaner body section 300 intakes dirt-bearing air, filters the intaken air to eliminate the dirt from the dirt-bearing air, and exhausts the dirt-eliminated or clean air. The brush section 306 is in contact with a place to be cleaned and provides an air passageway therein for the dirt-bearing air to flow from the place to the first connector section 360*a*.

The first connector section 360*a* has first and second protrusions 330*a* and 330*b* which protrude in the opposite directions to insert into the first and second slots 341*a* and 341*b*, respectively. The first and second protrusions 330*a* and 330*b* are slidably connected in the first and second slots 341*a* and 341*b*, respectively, while the first recess 312*a* is placed on the first connector section 360*a* to be slid along the first and second protrusions 330*a* and 330*b*. The brush section 306 is detachably connected to the first connector section 360*a* to provide the air passageway for the dirt-bearing air to enter from the brush section 306.

The second connector section 360*b* is fixedly inserted in the second or rear recess 312*b* and connected to the first connector section 360*a* to provide an air passageway for the dirt-bearing air.

The suction pipe section 350 connects the second connector section 360*b* with the cleaner body section 300 to provide an air passageway for the dirt-bearing air to flow from the second connector section 360*b* to the cleaner body section 300. The suction pipe section 350 is detachably connected to the second connector section 360*b*. The suction pipe section 350 detached from the second connector section 360*b* can be detachably connected to the brush section 306 without both the first connector section 360*a* and the second connector section 360*b* to provide an air passageway for the dirt-bearing air to pass directly from the brush section 306 to the suction pipe section 350.

As shown in FIG. 3, the cleaner body section 300 encloses a dirt collecting chamber 303 and a cleaner motor chamber 305, as can be seen in the conventional vacuum cleaner. Reference numerals 304 and 305*a* denote a dirt-collecting envelope filter and a cleaner motor, respectively. Both chambers 303 and 305 are divided by a partition 302 having a hole (not shown) which communicates both chambers 303 and 305. These inner structures of the cleaner body section 300 may be easily found in this art. As shown in FIG. 3, the second or rear side 312*d* of the body section 300 has two openings 318 (only one shown) each communicating with each air exhaust portion 311*a*, 311*b* (explained later) in order for the dirt-eliminated air to flow into the corresponding air exhaust portions 311*a*, 311*b*. The air intaken into the air exhaust portion 311*a* is exhausted through plural air exhaust ports 319.

Referring again to FIG. 2, reference numerals 321, 321*k*, 320*a* and 320*b* denote a first main wheel, a second main wheel, a first auxiliary wheel and a second auxiliary wheel, respectively. The second or rear side 312*d* of the cleaner body section 300 has first and second air exhaust portions 311*a* and 311*b* which are separated oposite from each other. The second recess 312*b* is formed between the first and second air exhaust portions 311*a* and 311*b*. Each of the first and second air exhaust portions 311*a* and 311*b* has the plurality of air exhaust ports 319. Upper portions of the first and second air exhaust portions 311*a* and 311*b* have first and second grooves 321*a* and 321*b*, respectively. The first and second grooves 321*a* and 321*b* accommodate first and second auxiliary wheels 320*a* and 320*b*, respectively. The first and second grooves 321*a* and 321*b* are formed on each side of the first and second air exhaust portions 311*a* and 311*b* each of which is parallel with the second recess 312*b*.

Further, the cleaner body section 300 has a third or left side 301*a* and a fourth or right side 301*b* which are in parallel and opposite to each other and each of which forms a right angle with respect to both the first side 312*c* and the second side 312*d*. The third side 301*a* has a third recess 322*a* for accommodating the first main wheel 321. The third recess 322*a* is formed in a shape corresponding to the first main wheel 321. The third recess 322*a* has an opening 321*i* to receive a center shaft (not shown) of the first main wheel 321. The fourth side 301*b* has a fourth recess and an opening (both not shown) similar to a configuration of the third side 301*a*.

Figure 2B:
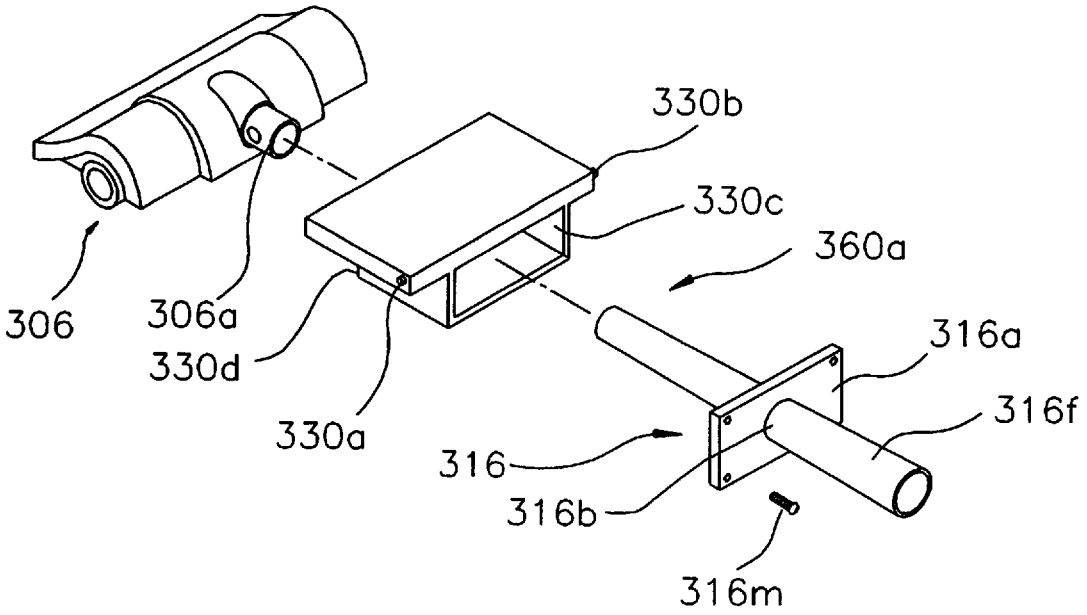
FIG. 2B is an exploded perspective view of the first connector section of FIG. 2.

FIG. 2B is an exploded perspective view of the first connector section of FIG. 2. As shown in FIGS. 2, 2A, and 2B the first connector section 360*a* connected with the first and second slots 341*a* and 341*b* through the first and second protrusions 330*a* and 330*b* is placed between the first and second main wheels 321*a* and 321*b*. The first connector section 360*a* has a first container 314 and a first air guider 316. The first container 314 is formed in a rectangular box shape. The rectangular box has an open side 330*c* and a front side 330*d* having a first center hole 330*e*. The front side 330*d* is opposite to the open side 330*c*. The first and second protrusions 330*a* and 330*b* extend in opposite directions from each other from the upper surface of the first connector section 360*a*, respectively. The first air guider 316 has a first lid 316*a* having a first lid hole 316*b* on the center portion thereof and a first hose 316*f*. The first hose 316*f* is slightly curved and fixedly inserted in the first lid hole 316*b*. When the first container 314 and the first air guider 316 are assembled together, one end portion of the first hose 316*f* is also inserted in the first center hole 330*e*. The first lid 316*a* covers the open side 330*c* and is fixed by a plurality of first engagement members 316*m* such as screws. The one end portion of the first hose 316*f* protrudes through the first center hole 330*e* to be detachably connected with a brush hose 306*a* to provide an air passageway from the brush section 306 to the first connector section 360*a*.

Figure 2C:
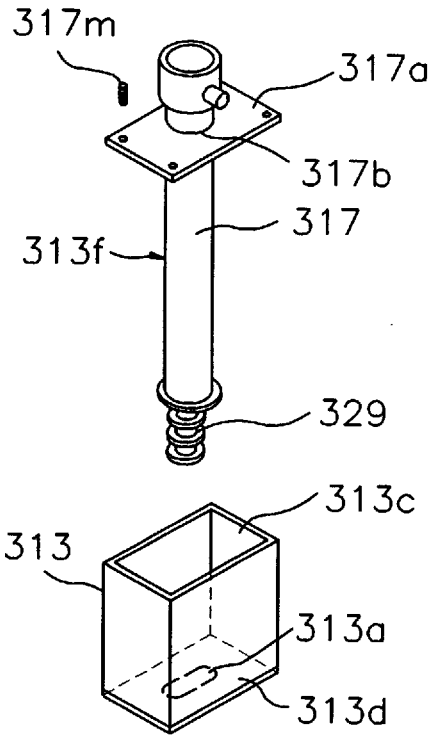
FIG. 2C is an exploded perspective view of a second connector section of FIG. 2.

FIG. 2C is an exploded perspective view of a second connector section of FIG. 2. The second connector section 360*b* is fixedly inserted in the second recess 312*b*. The second connector section 360*b* has a second container 313 and a second air guider 313*f*. The second container 313 is formed in a rectangular box shape. The rectangular box has an open side 313*c* and a bottom side 313*d* having a second center hole 313*a*. The bottom side 313*d* is opposite to the open side 313*c*. The second air guider 313*f* has a second lid 317*a*, and a second hose 317 having a flexible portion 329. The second hose 317 is slightly curved and is fixedly inserted in the second lid hole 317*b*. When the second container 313 and the second air guider 313*f* are assembled together, one end portion, including the flexible portion 329, of the second hose 317 is also inserted in the second center hole 313*a*. The second lid 317*a* covers the open side 313*c* and is fixed by a plurality of second engagement members 317*m* such as screws. The one end portion of the second hose 317 is extended through the second center hole 313*a* in order for a part of the flexible portion 329 to be connected in the other end portion of the first hose 316*f*, so that an air passageway is provided from the first connector section 360*a* to the second connector section 360*b*.

The suction pipe section 350, as shown in FIG. 2, may have a plurality of sectioned suction pipes 350*a*, 350*b*, a grip 308, and a flexible hose 309, to be easily operated by hand while moving the cleaner or the suction pipe section 350. Here, one end of the sectioned suction pipe 350*b* is detachably connected to the other end portion of the second hose 317 (FIG. 2C). Further, when the one end of the sectioned suction pipe 350*b* is detached from the second connector section 360*b*, the one end of the sectioned suction pipe 350*b* is detachably connected to the brush hose 306*a* (FIG. 2B) to provide an air passageway directly from the brush section 306 to the cleaner body section 300.

Hereinafter, operations of the dual mode vacuum cleaner having the above structure according to the embodiment of the present invention will be described in detail.

Figure 4:
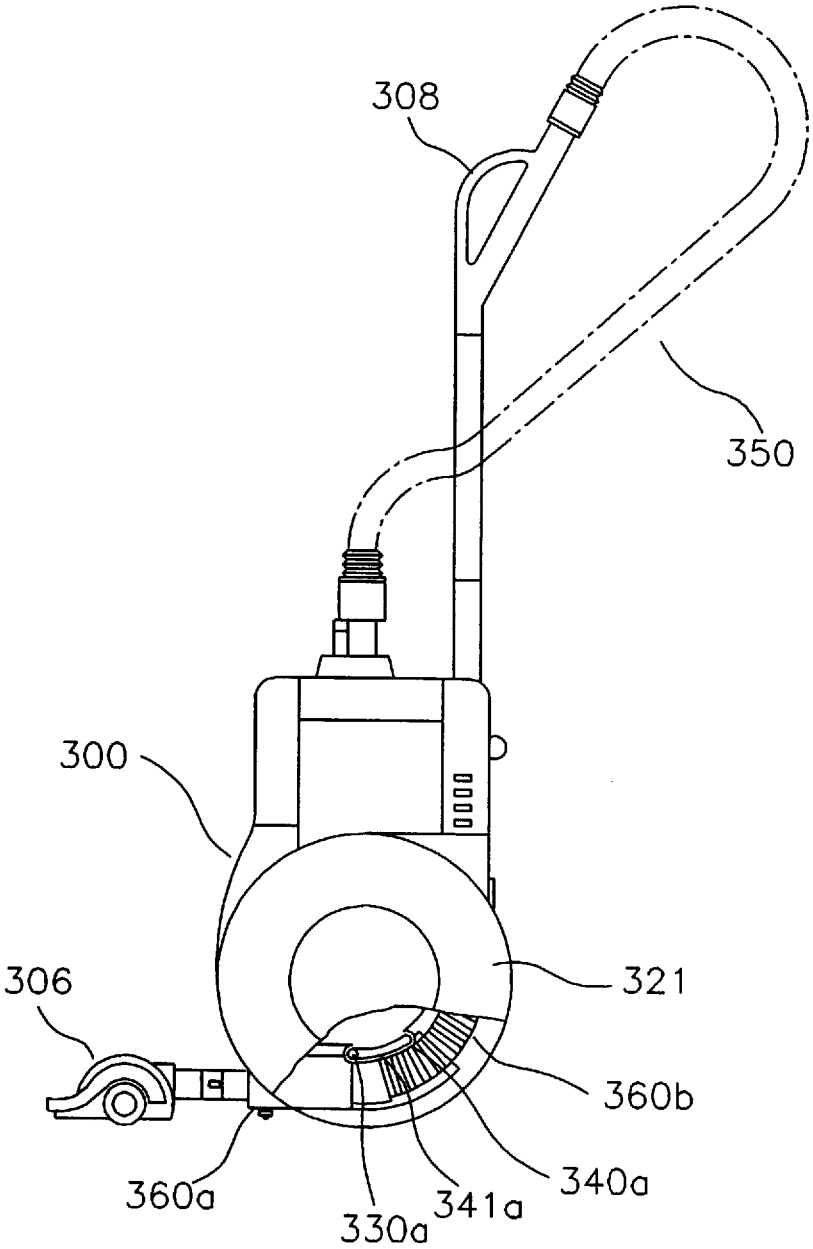
FIG. 4 is a perspective view of the vacuum cleaner of FIG. 2 for use in an upright mode in which the cleaner body and the ground form a right angle.
Figure 5:
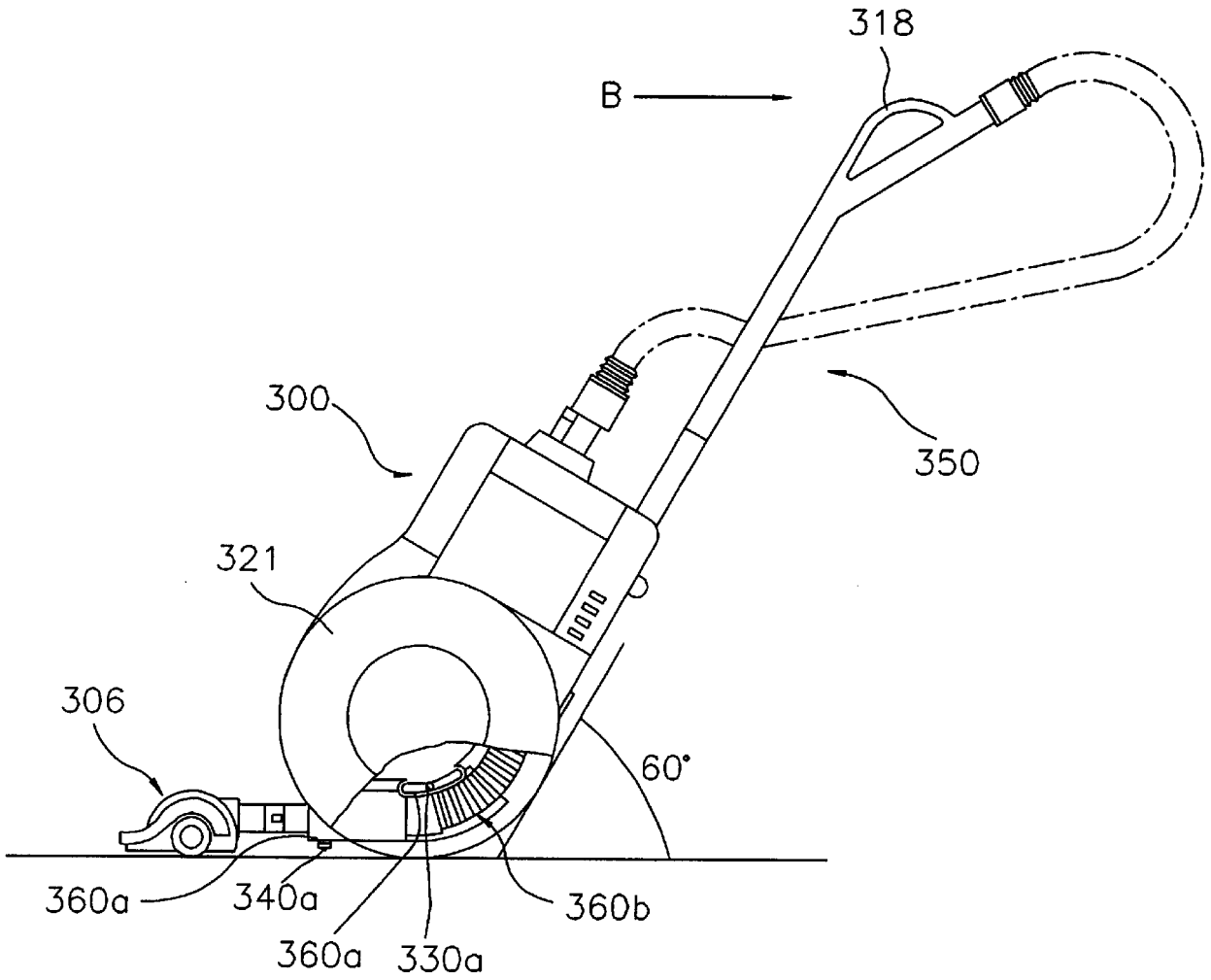
FIG. 5 is a perspective view of the vacuum cleaner of FIG. 2 for use in an upright mode in which the cleaner body and the ground make an angle of 60°.
Figure 6:
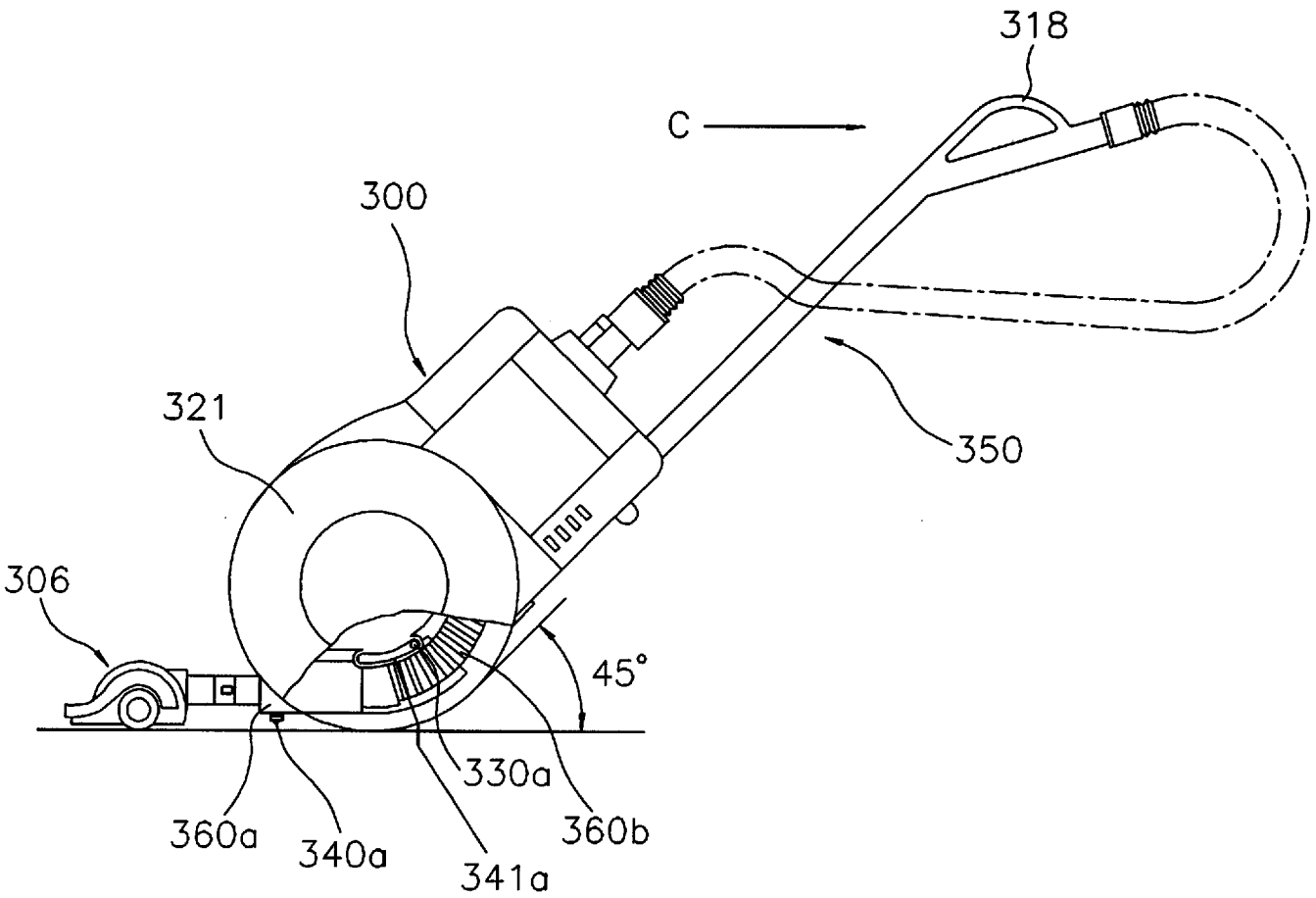
FIG. 6 is a perspective view of the vacuum cleaner of FIG. 2 in use as an upright mode in which the cleaner body and the ground form an angle of 45°.

FIGS. 4, 5 and 6 are perspective views of the dual mode vacuum cleaner of FIG. 2 for use in an upright mode in which the cleaner body and the ground form a right angle, an angle of 60°, and an angle of 45°, respectively. As shown in FIGS. 2 and 2B, in order for the vacuum cleaner according to the embodiment of the present invention to be used in an upright mode, the brush hose 306*a* of the brush section 306 is connected to the one end portion of the first hose 316 which is extended through the first center hole 330*e* of the first connector 314. The other end portion of the first hose 316 extended through the first hole of the first lid 316*a* is fixedly connected to one end portion of the flexible portion 329 of the second hose 317 (FIG. 2C) which is extended through the second center hole 313*a* of the second container 313. The first connector section 360*a* and the second connector section 360*b* may form various angles up to a right angle with respect to each other due to the flexible portion 329 of the second hose 317. The one end portion of the second hose 317 which is extended through the hole of the second lid 317*a* is detachably connected to one end of the second suction pipe 350*b* of the suction pipe section 350 (FIG. 2). The second connector section 360*b* is fixedly inserted into the second recess 312*b*, and the first or bottom side 312*c* of the cleaner body section 300 is placed on the first connector section 360*a*, and the first and second protrusions 330*a* and 330*b* of the first connector section 360*a* are slidably inserted in the first and second slots 341*a* and 341*b* (FIG. 2A). As shown in FIG. 4, the cleaner body section 300 forms a right angle with respect to the ground when the vacuum cleaner 1 is used in the upright mode, and the first side 312*c* of the cleaner body section 300 is completely placed on the first connector section 360*a*, and the first protrusion 330*a* is at one end of the first slot 341*a* adjacent to the brush section 306. As shown in FIGS. 5 and 6, when force is applied to the grip 308 in the directions of arrows B and C, the first connector section 360*a* is still placed on the ground, but the first or bottom side 312*c* of the cleaner body section 300 is lifted from the upper surface of the first connector section 360*a*, in which the first protrusion 330*a* slides backwards along the first slot 341*a*. At an angle of 45°, the protrusion 330*a* is at another end of the first slot 341*a* adjacent to the second connector section 360*b*. In the upright mode, the first and second main wheels are used to move the vacuum cleaner.

Figure 7:
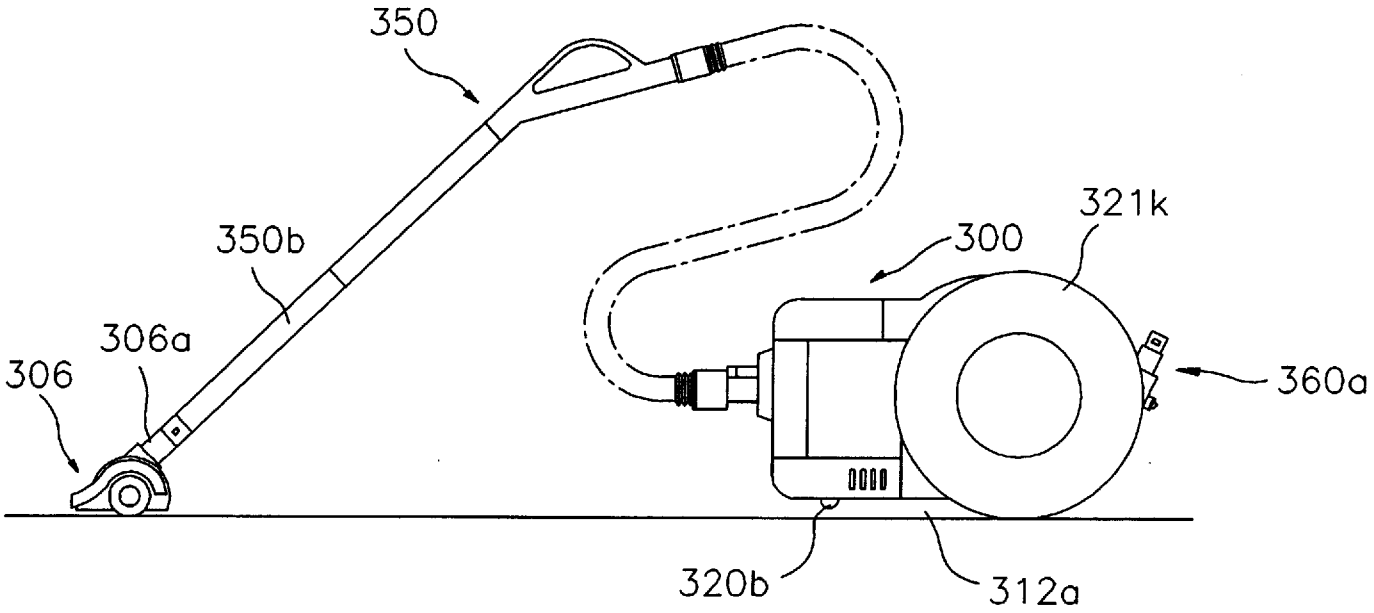
FIG. 7 is a perspective view of the vacuum cleaner of FIG. 2 for use in a canister mode in which the suction pipe section is directly connected to the brush section.

FIG. 7 is a perspective view of the vacuum cleaner of FIG. 2 for use in a canister mode, in which the suction pipe section 350 is directly connected to the brush section 306. When the vacuum cleaner is used in a canister mode, the sectioned suction pipe 350*b* of the suction pipe section 350 is detached from the second connector section 360*b*, and the brush section 306 is detached from the first connector section 360*a*. The detached sectioned suction pipe 350*b* is connected to the brush hose 306*a* of the brush section 306 to provide an air passageway directly from the brush section 306 to the cleaner body section 300 through the suction pipe section 350. In the canister mode, the first and second main wheels 321 and 321*k* and the first and second auxiliary wheels 320*a* and 320*b* are used to move the vacuum cleaner, in which the second or rear side 312*a* of the cleaner body section 300 faces to the ground.

As described above, the vacuum cleaner of the present invention can be used in both a canister mode and an upright mode without a reduction in cleaning performance and easily converted from the canister mode to the upright mode and vice versa.

What is claimed is:

1. A vacuum cleaner for both upright and canister modes, comprising:

a cleaner body section having a first recess in which a first connector section is placed, which is formed at a first side of the cleaner body section which is defined as a bottom side thereof, and a second recess in which a second connector section is placed, which is formed at second side of the cleaner body section which is defined as a rear side thereof, wherein the first and second sides form a right angle, and a couple of fitting portions are provided at the first side adjacent to the second side, the first and second fitting portions are spaced at a predetermined distance from each other and each has first and second slots, respectively;

first and second main wheels which are rotatable mounted parallel to the surface confined by each edge of the first side and the second side, respectively, and first and second auxiliary wheels which are rotatable mounted under the second side;

a brush section being in contact with a place to be cleaned and providing an air passageway therein for the dirt-bearing air;

the first connector section having first and second protrusions which protrude in opposite directions to insert into the first and second slots, respectively, and the first connector section detachably connected to the brush section, and for providing an air passageway for the dirt-bearing air to enter from the brush section, wherein the first and second protrusions are slidably mounted in the first and second slots, respectively, while the first recess receives the first connector section to be slid along the first and second protrusions;

the second connector section fixedly inserted in the second recess and connected to the first connector section, and for providing an air passageway for the dirt-bearing air; and a suction pipe section having a detachably connected end to the cleaner body and another free end;

wherein, in an upright mode, the brush section is connected to the first connector section, and the second connector section is connected to the free end of the suction pipe section, and tilt of the cleaner body which is placed on the first connector section and moves by the first and second main wheels is adjusted by the suction pipe section, whereas in a canister mode, the brush section is connected to the free end of the suction pipe section, and the second side of the cleaner body faces the ground, and the first and second main wheels and the first and second auxiliary wheels are utilized to move the cleaner body having the first connector section and the second connector section mounted thereon.

2. The vacuum cleaner for both upright and canister modes as claimed in claim 1, wherein the second side of the cleaner body section has first and second air exhaust portions which are separated from each other at each opposite edge of the second side parallel to the suction pipe section, the second recess is formed between the first and second air exhaust portions, and each of the first and second air exhaust portions has a plurality of air exhaust ports.

3. The vacuum cleaner for both upright and canister modes as claimed in claim 2, wherein the cleaner body section has a third side and a fourth side which are parallel and opposite to each other and each of which forms a right angle with respect to each of the first side and the second side, the third side having a third recess for accommodating the first main wheel of the clean body section, the third recess being formed in a shape corresponding to the first main wheel, the recess having an opening to receive a center shaft of the first main wheel, and the fourth side having a fourth recess and an opening similar to a configuration which the third side has.

4. The vacuum cleaner for both upright and canister modes as claimed in claim 3, wherein upper portions of the first and second air exhaust portions have first and second grooves for accommodating first and second auxiliary wheels respectively, the first and second grooves are formed on each rear side of the first and second air exhaust portions, each of which is parallel with the second recess.

5. The vacuum cleaner for both upright and canister modes as claimed in claim 3, wherein the first connector section is placed between the first and second main wheels.

6. The vacuum cleaner for both upright and canister modes as claimed in claim 2, wherein the second side of the cleaner body section has first and second openings each communicating with each air exhaust portion in order for the dirt-eliminated air to flow into the first and second air exhaust portions, and the air flowing into the first and second air exhaust portions is exhausted through a plurality of air exhaust ports.

7. The vacuum cleaner for both upright and canister mode as claimed in claim 1, wherein the first connector section has a first container and a first air guider, the first container being formed like a rectangular box, the rectangular box has an open side and a front side having a first center hole, the front side is opposite to the open side, the first and second protrusions extend in opposite directions from each other on the upper surface of the first connector section, respectively, the first air guider has a first lid having a first lid hole on the center portion thereof and a first hose, the first hose is fixedly inserted in the first lid hole, and one end portion of the first hose is also inserted in the first center hole when the first container and the first air guider are assembled together.

8. The vacuum cleaner for both upright and canister modes as claimed in claim 7, wherein the first lid covers the open side and is fixed by a plurality of first engagement members, the one end portion of the first hose protrudes through the first center hole to be detachably connected with a brush hose to provide an air passageway from the brush section to the first connector section.

9. The vacuum cleaner for both upright and canister modes as claimed in claim 1, wherein the second connector section is fixedly inserted in the second recess, and has a second container and a second air guider, the second container being formed like a rectangular box, the rectangular box has an open side and a bottom side having a second center hole, the bottom side is opposite to the open side, the second air guider has a second lid having a second lid hole, and a second hose having a flexible portion, the second hose is fixedly inserted in the second lid hole, and one end portion, including the flexible portion, of the second hose is also inserted in the second center hole when the second container and the second air guider are assembled together.

10. The vacuum cleaner for both upright and canister modes as claimed in claim 9, wherein the second lid covers the open side and is fixed by a plurality of second engagement members, the one end portion of the second hose extends through the second center hole in order for a part of the flexible portion to be connected to the other end portion of the first hose, so that an air passageway is provided from the first connector section to the second connector section.

* * * * *